US005215018A

United States Patent [19]

Sardari et al.

[11] Patent Number: 5,215,018

[45] Date of Patent: Jun. 1, 1993

[54] POLLUTION CONTROL APPARATUS AND METHOD FOR POLLUTION CONTROL

[75] Inventors: Abbas Sardari, Laguna Beach; John D. Von Bargen, Cypress, both of Calif.

[73] Assignee: White Horse Technologies, Inc., Irvine, Calif.

[21] Appl. No.: 824,557

[22] Filed: Jan. 23, 1992

Related U.S. Application Data

[62] Division of Ser. No. 545,335, Jun. 26, 1990, Pat. No. 5,088,424.

[51] Int. Cl.[5] ..... F23G 3/00

[52] U.S. Cl. ..... 110/235; 110/214; 110/234; 110/344; 110/345

[58] Field of Search ..... 110/344, 214, 234, 345, 110/235

[56] References Cited

U.S. PATENT DOCUMENTS

| | | | |
|---|---|---|---|
| 3,463,599 | 8/1969 | Welty, Jr. | 110/344 |
| 3,472,498 | 10/1969 | Price . | |
| 3,530,807 | 9/1970 | Zalman . | |
| 3,548,761 | 12/1970 | Zalman . | |
| 4,078,503 | 3/1978 | von Dreusche, Jr. | 110/345 |
| 4,101,632 | 7/1978 | Lamberti et al. | 110/345 |
| 4,206,722 | 6/1980 | Nolley, Jr. | 110/345 |
| 4,246,853 | 1/1981 | Mehta | 110/344 |
| 4,395,958 | 8/1983 | Caffyn et al. . | |
| 4,452,152 | 6/1984 | John et al. . | |
| 4,473,013 | 9/1984 | John et al. . | |
| 4,485,746 | 12/1984 | Erlandsson . | |
| 4,718,361 | 1/1988 | Berry | 110/345 |
| 4,726,302 | 2/1988 | Hein et al. | 110/345 |
| 4,761,132 | 8/1988 | Khinkis | 110/345 |
| 4,846,082 | 7/1989 | Marangoni | 110/234 |
| 4,951,579 | 8/1990 | Bell | 110/214 |

FOREIGN PATENT DOCUMENTS

| | | |
|---|---|---|
| 0319468 | 6/1989 | European Pat. Off. . |
| 0372075 | 6/1990 | European Pat. Off. . |
| 2004627 | 4/1979 | United Kingdom . |

OTHER PUBLICATIONS

Revue Generale De Thermique, No. 293, May 1986, Paris p. 303.

*Primary Examiner*—Henry C. Yuen
*Attorney, Agent, or Firm*—Frank J. Uxa

[57] ABSTRACT

A method of thermally oxidizing a gaseous component, e.g., including one or more volatile organic compounds, is disclosed. This method comprises passing an amount of an oxygen component, a controlled amount of a fuel component and an amount of a gaseous component to be thermally oxidized to a combustion zone to combust the oxygen component and the fuel component, to at least partially thermally oxidize the gaseous component and to form a gaseous effluent; contacting the gaseous effluent in a retention zone at conditions effective to thermally oxidize the gaseous component, and thereby form a flue gas; and controlling the amount of fuel component passed to the combustion zone based on the temperature in at least one of said combustion zone and said retention zone contacting occurs. A thermal oxidation apparatus useful for practicing the present method is also disclosed.

13 Claims, 1 Drawing Sheet

POLLUTION CONTROL APPARATUS AND METHOD FOR POLLUTION CONTROL

This application is a division of application Ser. No. 545,335, filed Jun. 26, 1990, now U.S. Pat. No. 5,088,424.

BACKGROUND OF THE INVENTION

This invention relates to a method and apparatus for thermally oxidizing a gaseous material, e.g., a gas and/or vapor, in particular a gaseous material including volatile organic compounds or components. In particular, this invention relates to a method and apparatus for thermally oxidizing such gaseous material to render the gaseous material more environmentally acceptable and, preferably, to usefully transfer the heat evolved in such thermal oxidation, e.g. to thereby generate steam and/or hot water and/or hot oil.

Environmental concerns are becoming increasingly important, particularly in industries which produce, e.g., as primary products and/or by-products, volatile organic compounds or components, hereinafter referred to as VOC, which are released to the environment. Regulatory authorities have required that such VOC, in particular VOC which are hazardous to the health and/or safety of humans and/or other organisms, be treated to become and/or provide products which are more environmentally acceptable than the original VOC.

One useful approach to this pollution problem involves thermally oxidizing the VOC to produce materials which can be readily and safely released to the atmosphere. During the thermal oxidation of such VOC, a substantial amount of heat is produced. In certain instances where VOC is thermally oxidized, the resulting flue gases have been passed through a waste heat boiler installation to produce or generate steam and/or hot water. One problem which has arisen in the past is the process control of such a VOC thermal oxidation/waste heat boiler installation facility. This problem is particularly acute since the production of VOC to be thermally oxidized and the amount of steam/hot water required from the facility can be independent of each other.

Previous control systems have controlled the amount of added fuel, e.g., natural gas, propane, diesel fuel and the like, fed to the thermal oxidizer and the amount of air fed to the thermal oxidizer solely to regulate VOC emissions from the process. When steam demand is low, the fuel and air fed to the thermal oxidizer is maintained at a relatively high level so as to insure VOC thermal oxidation. Such control systems result in a substantial amount of energy being wasted by exhausting hot flue gases to the atmosphere. Moreover, previous systems utilized to destroy gaseous materials utilized very severe conditions which often involved unneeded combustion, which combustion itself often resulted in unnecessary air pollution.

In certain solid waste incinerators, the temperature in the combustion chamber is used to control the amount of fuel fed to the incinerator. See Zalman U.S. Pat. Nos. 3,530,807 and 3,548,761. However, in neither of these systems is gaseous material fed to a thermal oxidizer for thermal oxidation. Separate steam generators are employed in these systems. In addition, no steam is produced outside the combustion chamber itself, or for use elsewhere than in the incinerator to scrub particulates from the exhaust gas.

It would be clearly advantageous to provide a system which is controlled to provide effective and efficient thermal oxidation and useful heat transfer with controlled, e.g., reduced, fuel consumption.

SUMMARY OF THE INVENTION

A new thermal oxidation method and apparatus has been discovered. The present thermal oxidizing system is particularly useful in treating gaseous components, especially gaseous components containing one or more volatile organic compounds or components (VOC). As used herein, the term "gaseous component" refers to gases and mixtures thereof, and to gases and mixtures thereof which include entrained liquids, i.e., vapors. In addition, the present system preferably provides cost effective and controlled amounts of useful heat transfer, in particular for the generation of steam and/or hot water and/or hot water and/or the like, especially steam. The present system utilizes temperature control to ensure that the compound or compounds in the gaseous component to be thermally oxidized or treated are effectively thermally oxidized or treated, e.g., destroyed, modified or converted into a compound or compounds which are more environmentally acceptable than the original compound or compounds in the gaseous component fed to the system. This is accomplished in such a manner so that controlled, and preferably reduced, amounts of added fuel, e.g., natural gas, propane, diesel fuel, other petroleum distillates, petroleum residua and the like, are used. Further, the amount of useful heat transfer preferably achieved in such a thermal oxidation system is controlled to meet the demand for such heat transfer, e.g., the demand for steam and/or hot water. In short, the present system provides for effective pollution control by thermal oxidation while controlling the amount of fuel utilized for such pollution control thermal oxidation.

In one broad aspect, the present invention is directed to a method for thermally oxidizing a gaseous component, in particular VOC. This method comprises passing an amount of an oxygen component, a controlled amount of a fuel component and the gaseous component to be thermally oxidized to a combustion zone to combust the oxygen component and the fuel component, to at least partially thermally oxidize the gaseous component, preferably to a product or products which are more environmentally acceptable than the original gaseous component, and to form a gaseous effluent. This gaseous effluent is contacted in a retention zone, which may be a portion of the combustion zone, e.g., a portion of the combustion chamber, and/or may be located away from, e.g., downstream of, the combustion zone, at conditions effective to thermal oxidize the gaseous component and to form a flue gas, which may be exhausted to the atmosphere.

The present method involves controlling the amount of fuel component passed to the combustion zone based on the temperature in at least one of the combustion zone and the retention zone. The present retention zone is maintained at conditions, in particular a temperature, at which thermal oxidation of the gaseous component can occur. The temperature control mechanism described above effectively controls the amount of fuel component added to the combustion zone so as to reduce the cost of such thermal oxidation. This approach is substantially different from prior art systems for thermally oxidizing gaseous materials in which fuel and oxygen were provided without regard to the temperature in the combustion chamber or downstream of the combustion chamber.

In a particularly useful embodiment, the present method further comprises providing means to transfer heat from the flue gases to generate a useful product, e.g., steam, hot water, hot oil and the like, in particular steam. The amount of useful product, e.g., steam, generated is preferably controlled. For example, the amount of useful product generated can be controlled by controlling the flow path of the flue gases. Thus, depending upon the amount of useful product to be produced, the flue gases can be exhausted directly to the atmosphere or can be passed through a heat exchange system, e.g., a boiler, to produce the desired amount of useful product.

In one useful embodiment, the temperature controlling step is effective to maintain the temperature in at least one of the combustion zone and the retention zone, preferably the retention zone, at at least about a predetermined, minimum value. This method preferably further comprises additionally controlling the amount of fuel component, and more preferably the amount of oxygen component, passed to the combustion zone based on the amount of useful product to be generated. This additional controlling step is effective only when the temperature in at least one of the combustion zone and the retention zone, preferably the retention zone, is at at least about the predetermined minimum value. This predetermined minimum value is selected to ensure that the gaseous component to be thermally oxidized is substantially completely thermally oxidized prior to leaving the retention zone. This additional controlling step preferably includes monitoring the pressure of the steam generated and, more preferably adjusting the amount of fuel component, and still more preferably oxygen component, fed to the combustion zone based on this pressure.

In another broad aspect of the present invention, an apparatus for thermal oxidizing a gaseous component, preferably VOC, comprises a combustion zone, a retention zone and control means. The combustion zone is sized and adapted to receive an amount of an oxygen component, a controlled amount of a fuel component, and an amount of gaseous component to be thermally oxidized and to provide a location for the combustion of the oxygen component, preferably including molecular oxygen, and the fuel component, preferably a hydrocarbon-based fuel such as those described elsewhere herein and the like, and at least the partial thermal oxidation of the gaseous component and the formation of a gaseous effluent. The retention zone, which may be a portion of the combustion zone and/or may be located away from the combustion zone, preferably located downstream of the combustion zone, provides a location where the gaseous effluent is passed and where the gaseous effluent is maintained at conditions effective to thermally oxidize the gaseous component, and where a flue gas is formed. The control means acts to control the amount of fuel component passed to the combustion zone based on the temperature in at least one of the combustion zone and the retention zone, preferably in the retention zone.

Preferably, the present apparatus further comprises means acting to transfer heat from the flue gas and generate a useful product, e.g., as described elsewhere herein, in particular steam. More preferably, the present apparatus further comprises product control means acting to control the amount of useful product, e.g., steam, generated.

The combustion zone preferably includes a burner section in which a combustion flame is initiated (e.g., through the use of a pilot light) and maintained, and a combustion chamber, preferably located downstream from the burner section, in which combustion occurs. In one embodiment, a portion of the gaseous component is preferably passed directly to the burner section, while another portion of the gaseous component is passed directly to the combustion chamber. The present apparatus preferably further comprises additional control means acting to control the amounts of fuel component, and more preferably oxygen component, passed to the combustion zone based on the amount of useful product, e.g., steam to be generated. This additional control means is activated only when the temperature in at least one of the combustion zone and the retention zone, preferably the retention zone, is at at least about a predetermined, minimum value.

In another embodiment, the present apparatus further comprises gaseous component control means acting to control the amount of the gaseous component passed to the combustion zone, preferably based on the pressure of the gaseous component upstream of the control point.

These and other aspects and advantages of the present invention are set forth in the following detailed description and claims, particularly when considered in conjunction with the accompanying drawing in which like parts bear like reference numerals.

DETAILED DESCRIPTION OF THE DRAWING

Figure 1:
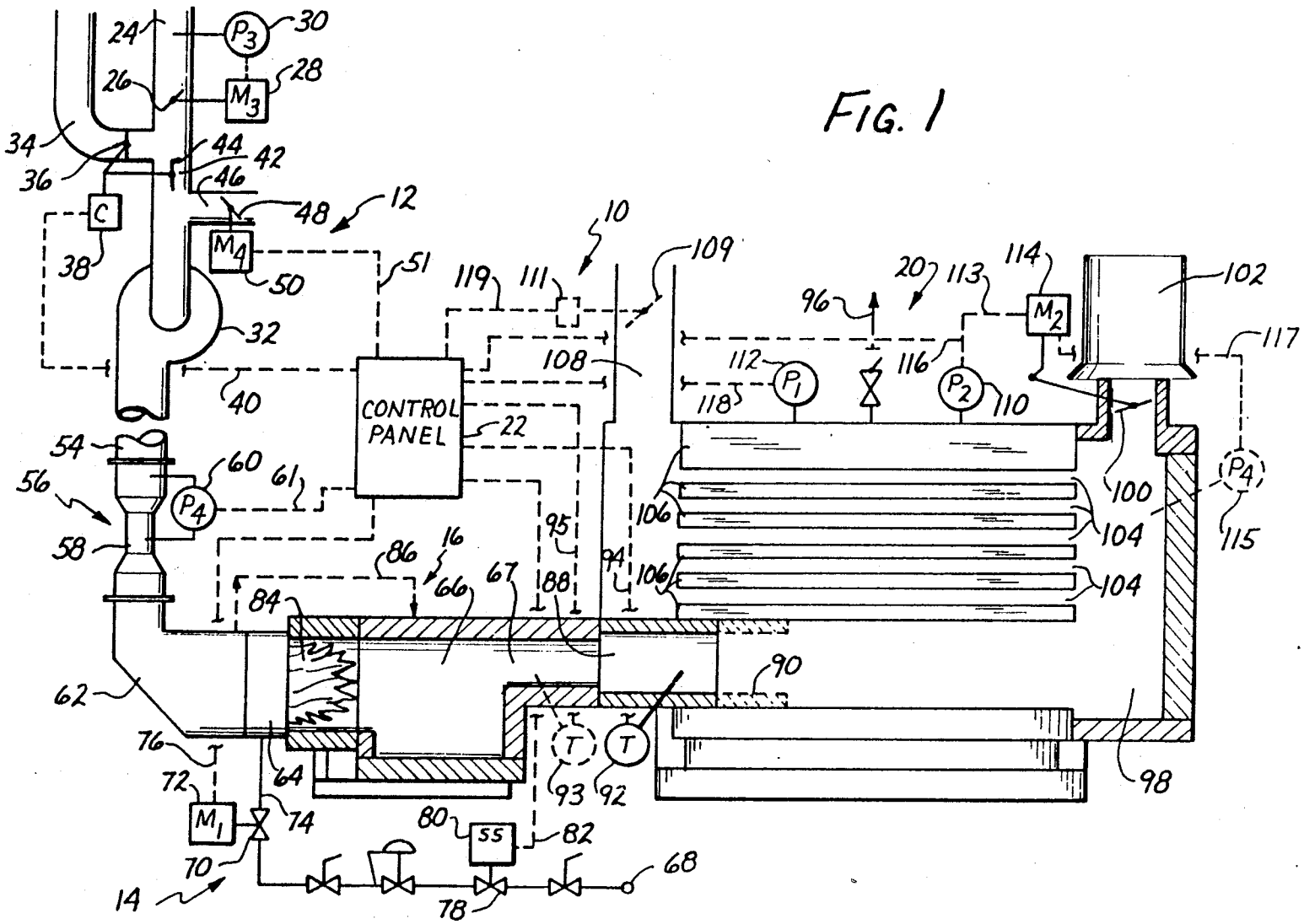
FIG. 1 is a generally schematic view of one embodiment of a thermal oxidation/steam generation apparatus in accordance with the present invention.

Referring now to FIG. 1, a thermal oxidation/steam generation apparatus in accordance with the present invention, shown generally at 10, includes a gas intake assembly 12, a fuel intake assembly 14, a combustion zone 16 and a boiler section 20. The apparatus 10 is controlled, as discussed in detail hereinafter, from a centralized control panel 22. The various components of control panel 22 may be selected from conventional and commercially available components which individually or together are useful to receive and transmit the control signals and alarm signals described herein. Examples of commercially available devices suitable for use as control panel 22 include burner management systems sold by Fireye, Inc. and Honeywell, Inc. Although each of the parts of apparatus 10 is discussed separately, the proper functioning of apparatus 10 depends on each of these parts working together effectively.

Gas intake assembly 12 includes a gas feed line 24 which passes VOC-contaminated air into apparatus 10, e.g., from one or more manufacturing facilities and/or storage facilities. Substantially any VOC or mixture thereof can be thermally oxidized in accordance with the present invention. For example hydrocarbons, substituted hydrocarbons, other organic compounds, mixtures thereof and the like can be thermally oxidized. Such VOC may be hazardous and/or non-hazardous. The amount of VOC-contaminated air which is passed to apparatus 10 varies from time to time. A VOC intake damper 26 is operated by damper motor 28 which, in turn, is controlled based on the pressure sensed by pressure sensor 30. The damper motors employed in apparatus 10 may be chosen from conventional and well known motors of this type, and may be powered electrically or pneumatically. The pressure sensors described herein may be of conventional design. The pressure sensed by pressure sensor 30 is at a point upstream of VOC intake damper 26 in feed line 24. The use of VOC intake damper 26 aids in controlling the suction pressure to air blower 32.

A fresh air inlet line 46 is provided to pass fresh air into apparatus 10 when needed. A fresh air damper 48, located in line 46 is positioned to allow fresh air to pass into air blower 32 or to be closed to such passage. Fresh air damper 48 is operated by damper motor 50 which is controlled by signals received from control panel 22 through control signal line 51. Fresh air damper 48 is closed when the amount of VOC-contaminated air from line 24 is sufficient to provide for the desired operation of apparatus 10. If additional air is required for such operation, e.g., to generate the desired amount of steam, fresh air damper 48 is opened to provide the same. In different alarm situations, fresh air damper 48 may be opened or closed depending on the specific alarm situation involved.

Both VOC-containing air gas feed line 24, and fresh air line 46 feed into blower inlet line 42. A blower inlet damper 44 is provided in line 42 and is normally positioned to allow passage of VOC-containing air into blower 32. However, in certain alarm situations, blower inlet damper 44 is moved to a closed positioned by operator 38 (which may be powered electrically or pneumatically) in response to signals received from control panel 22 via signal line 40. An emergency by-pass line 34 is provided with a by-pass damper 36, which is normally closed. In certain alarm situations, damper 36 is opened by operator 38 in response to signals received from control panel 22 via control signal line 40. Ordinarily, if by-pass damper 36 is closed, inlet damper 44 is open, and vice versa.

The air blower 32 pressurizes the gas in blower inlet line 42 in advance of such gas entering the combustion zone 16. Air blower 32 may be one of a number of conventional and well known devices such as, for example, blowers sold by Garden City Fan Company and New York Blower Company.

The VOC-containing air passes from air blower 32 through line 54 into a flash-back prevention system 56 which includes a section 58 of conduit which has a reduced cross-sectional area for fluid flow relative to line 54. A differential pressure sensor 60 monitors the difference in fluid pressure in line 54 and in section 58. If this difference falls below a predetermined minimum, an alarm signal is passed from pressure sensor 60 through signal line 61 to control panel 22 which, in turn, closes damper 42 and opens damper 36 to vent the VOC-containing air from line 24 to the atmosphere, and opens damper 48 to allow fresh air from line 46 to pass to air blower 32. Flash-back prevention system 58 is, in effect, a velocity monitor, and also protects the air blower 32 from being exposed to hot gases which are located downstream of air blower 32.

After the flash-back prevention system 56, VOC-containing air is passed through line 62 into combustion zone 16, which includes a burner section 64 and a chamber 66, which acts primarily as a combustion chamber. A portion of chamber 66, in particular the downstream portion 67 of chamber 66 further acts as a preliminary retention chamber. A fuel material, e.g., a hydrocarbon fuel such as natural gas, propane, diesel fuel and the like, is also passed to the combustion zone 16 using fuel intake assembly 14.

The fuel intake assembly 14 includes a fuel source 68, a series of valves, and a control valve 70, which is operated by valve motor 72. The various valves and valve motor 72 of fuel intake assembly 14 can be of conventional design. The amount of fuel fed to the combustion zone 16 through fuel supply line 74 is controlled by using valve motor 72 to vary the position of control valve 70. Valve motor 72 is operated in response to a signal from control panel 22 passed through signal line 76. In addition, safety valve 78 upstream of control valve 70 in line 74 is operated by a safety switch 80 which acts to shut or close safety valve 78 when it is activated to do so by an alarm signal from control panel 22 passed to safety switch 80 through signal line 82.

Both the VOC-containing air from line 62 and the fuel from line 74 are fed into the burner section 64 where a flame 84 is ignited and maintained. The combustion zone 16, e.g., burner section 64 and chamber 66, may be of conventional design. In certain designs, the VOC-containing air from line 62 can be split into two separate streams, with one portion being fed to the burner section 64 and the other portion being fed directly to the chamber 66. This embodiment is illustrated by line 86 (shown in shadow) passing from line 62 directly into chamber 66 and by-passing burner section 64. The use of this "split-air stream" embodiment is particularly useful if a low NOX (nitrogen oxide) premix burner is employed in the burner section 64.

The conditions in the burner section 64 and chamber 66 are sufficient to combust the fuel and oxygen fed to combustion zone 16. Excess oxygen is preferably present to provide for substantially complete combustion of the fuel. In addition, at least a portion of the VOC in the VOC-containing air fed to the combustion zone 16 is effectively thermally oxidized in the combustion zone 16 to form one or more compounds which are more environmentally acceptable than the compound or compounds making up the VOC fed to apparatus 10.

The hot effluent gases from the chamber 66 pass to an additional chamber 88 located downstream of chamber 66. Additional chamber 88 may be considered an extension of chamber 66. Here, in additional chamber 88, with the temperature maintained at or above a predetermined minimum value, e.g., at least about 1400° F., and oxygen available, the remaining VOC, if any, from the original VOC-containing air is effectively thermally oxidized. As shown in FIG. 1, the size of the additional chamber 88 can be varied to suit the particular application involved and to provide sufficient residence time for effective VOC thermal oxidation. Thus, in FIG. 1, an additional, variable length 90 (shown in shadow) of additional chamber 88 can be provided, if desired. The size and/or configuration of additional chamber 88 may influence the size and/or configuration of chamber 66. Additional chamber 88, and possibly downstream portion 67, is conveniently lined with high temperature insulation, refractory, ceramic or the like to retain heat. Existing installations, e.g., boilers, may be retrofitted in accordance with the present invention by, for example, replacing the existing combustion system with a new combustion system, such as combustion zone 16 and/or modifying the installation to provide an effective retention zone, such as by lining an area downstream of the burner with high temperature insulation, refractory, ceramic or the like.

An important feature of apparatus 10 is a temperature sensor 92, e.g., a conventional thermocouple, which measures or senses the temperature in additional chamber 88 downstream from chamber 66 and passes a temperature signal to control panel 22 through signal line 94. Alternately a temperature sensor 93 (shown in shadow) can be used to measure or sense the temperature in chamber 66 and pass a temperature signal to control panel 22 through signal line 95. If the temperature in additional chamber 88 (or in chamber 66, in particular in downstream portion 67) is below a predetermined, minimum value, e.g., about 1200° F. to about 1500° F., in particular about 1400° F., control panel 22 sends a signal to fuel intake assembly 14 through signal line 76 to increase the amount of fuel passed to combustion zone 16. In this manner, the temperature in additional chamber 88 (or downstream portion 67) is controlled to provide effective conditions for VOC thermal oxidation. The additional chamber 88 is chosen to be compatible, e.g., in size and materials of construction, with the other components of the system and to effectively thermally oxidize any VOC passing from the combustion zone 16.

The flue gases produced in additional chamber 88 pass into boiler section 20 where steam is produced based on steam demand in a plant steam line 96. In effect, the flue gases from addition chamber 18 have two alternative paths through boiler section 20. First, if steam demand is low, the flue gases can pass through conduit 98, past exhaust damper 100, which is open, and into exhaust conduit 102 through which it is passed and allowed to escape to the atmosphere. Alternately, if steam demand is high, exhaust damper 100 is closed and the flue gases from conduit 98 are forced to pass through heat exchange tubes 104 where heat is removed from the flue gases and used to heat water in a shell, illustrated schematically at 106, and generate steam which leaves by plant steam line 96. In certain applications, the exhaust conduit 102 and exhaust damper 100 are not present so that the flue gas is forced to pass through heat exchange tubes 104. After this heat exchange operation, the cooled flue gases pass through cool exhaust conduit 108 and are exhausted to the atmosphere. The heat exchange system of boiler section 20 may be of conventional design.

The operation of boiler section 18 is controlled as follows. Two pressure sensors 110 and 112 monitor the pressure in shell 106. Pressure sensor 110 is associated with an exhaust damper motor 114 and controls its operation. If the pressure sensed by pressure sensor 110 is above a predetermined maximum value, a signal is passed through signal line 113 to exhaust damper motor 114 which is activated to open exhaust damper 100. This reduces the amount of steam generated and allows the flue gas to exhaust through exhaust conduit 102. If the pressure sensed by pressure sensor 110 is below a predetermined minimum value, exhaust damper motor 114 is activated to close exhaust damper 100 and cause the flue gases to pass through tubes 104 and generate increased amounts of steam. Pressure sensor 110 also provides signals, through signal line 116, to control panel 22 to warn of (or provide an alarm for) high pressure in shell 106.

Pressure sensor 112 is associated with control panel 22 by signal line 118. When pressure sensor 112 senses a pressure in shell 106 below a predetermined minimum value (an indication that steam demand is high), a signal is passed through signal line 118 to control panel 22 which, in turn, sends signals to the fuel intake assembly 14 to increase the amount of fuel sent to combustion zone 16. In addition, if the amount of VOC-containing air in line 42 is insufficient to combust the increased amount of fuel, control panel 22 also sends a signal to gas intake assembly 12 to increase the amount of fresh air passed to combustion zone 16.

Alternately, an exhaust conduit damper 109 (shown in shadow) in exhaust conduit 108 may be used to control the path of the flue gas. Thus, damper 109 is driven by exhaust conduit damper motor 111 (shown in shadow) which operates in response to the pressure sensed by pressure sensor 110. When steam demand decreases, pressure sensor 110 provides a signal through signal line 116 to control panel 22 which, in turn, sends a signal through signal line 119 to damper motor 111 to close damper 109. This causes the pressure in conduit 98 to increase. This increased pressure is sensed by pressure sensor 115 (shown in shadow) which passes a signal through signal line 117 to exhaust damper motor 114 to open exhaust damper 100, thus exhausting the flue gas to the atmosphere. By reverse analogy, when steam demand increases, this alternate system functions to open exhaust conduit damper 109 and close exhaust damper 100.

Although the embodiment illustrated shows heat transfer to generate steam, and steam generation is preferred, the present invention is applicable to employing heat transfer from the flue gas to generate other useful products, such as hot water, hot oil and the like, instead of, or in combination with, steam generation. The generation employing flue gas heat transfer of such other useful products is within the scope of the present invention.

As can be seen from the above description, the VOC fed to apparatus 10 is effectively thermally oxidized, while controlling the amount of fuel used. In addition, increased amounts of steam can be produced when steam demand is high. The present system employs strategically placed sensors, preferably both temperature and pressure sensors, to control the present thermal oxidation/steam generation system to achieve the desired results while controlling the amount of fuel employed.

While this invention has been described with respect to various specific examples and embodiments, it is to be understood that the invention is not limited thereto and that it can be variously practiced within the scope of the following claims.

What is claimed is:

1. An apparatus for thermally oxidizing a gaseous component comprising:

a combustion zone sized and adapted to receive an amount of an oxygen component, a controlled amount of a fuel component, and an amount of a gaseous component to be thermally oxidized and to provide a location for the combustion of said oxygen component and said fuel component, at least the partial thermal oxidation of said gaseous component and the formation of a gaseous effluent;

a retention zone, located downstream from said combustion zone, to which said gaseous effluent is passed and where said gaseous effluent is maintained at conditions effectively to thermally oxidize said gaseous component, thereby producing a flue gas;

a heat transfer assembly located so as to receive said flue gas to transfer heat from said flue gas, thereby generating a useful product;

a control assembly to control the amount of fuel component passed to said combustion zone based on the temperature in said retention zone so as to maintain the temperature in said retention zone at at least a predetermined, minimum value; and an additional control assembly to control the amount of fuel component passed to said combustion zone based on the amount of useful product to be generated, said additional control assembly being effective only when the temperature in said retention zone is at least about a predetermined, minimum value.

2. The apparatus of claim 1 wherein said combustion zone includes a burner section in which a combustion flame is initiated, and a combustion chamber located downstream from said burner section and in which combustion occurs, and a portion of said gaseous component is passed directly to said burner section and another portion of said gaseous component is passed directly to said combustion chamber.

3. The apparatus of claim 1 which further comprises gaseous component control assembly to control the amount of the gaseous component passed to said combustion zone based on the pressure of the gaseous component upstream of the point at which the amount of the gaseous component passed to said combustion zone is controlled.

4. The apparatus of claim 1 wherein said transfer heat assembly generates steam, and which further comprises a steam control assembly to control the amount of steam generated.

5. The apparatus of claim 4 wherein said steam control assembly is effective to control the flow path of said flue gas.

6. The apparatus of claim 1 wherein said additional control assembly further controls the amount of oxygen component passed to said combustion zone based on the amount of useful product to be generated.

7. The apparatus of claim 1 wherein said gaseous component includes at least one volatile organic compound and said flue gas includes the thermally oxidized product or products of said volatile organic compound, said thermally oxidized product or products having increased environmental acceptability relative to said volatile organic compound.

8. The apparatus of claim 1 wherein said gaseous component to be thermally oxidized is selected from the group consisting of hydrocarbons, substituted hydrocarbons and mixtures thereof.

9. The apparatus of claim 1 wherein said oxygen component includes molecular oxygen, and said fuel component includes one or more hydrocarbon compounds.

10. The apparatus of claim 4 wherein said steam control assembly controls the amount of steam generated based on the pressure of the generated steam.

11. The apparatus of claim 1 wherein said useful product is steam and said additional control assembly controls the amount of oxygen component passed to said combustion zone based on the amount of steam to be generated.

12. The apparatus of claim 11 wherein said additional control assembly monitors the pressure of the steam generated.

13. The apparatus of claim 1 wherein said oxygen component includes molecular oxygen, said fuel component includes one or more hydrocarbon compounds, and said gaseous component to be thermally oxidized is selected from the group consisting of hydrocarbons, substituted hydrocarbons and mixtures thereof.

* * * * *

UNITED STATES PATENT AND TRADEMARK OFFICE

CERTIFICATE OF CORRECTION

PATENT NO. : 5,215,018

DATED : June 1, 1993

INVENTOR(S) : Sardari et al

It is certified that error appears in the above-identified patent and that said Letters Patent is hereby corrected as shown below:

Column 7, line 29; delete "18" and insert in place thereof --88--

Column 7, line 29; delete "addition" and insert in place thereof --additional--

Column 8, line 66; delete "effectively" and insert in place thereof --effective-- (Claim 1)

Column 9, claim 3, line 24; after"comprises" insert --a--

Signed and Sealed this

Eighteenth Day of January, 1994

Bruce Lehman

*Attest:*

BRUCE LEHMAN

*Attesting Officer*

*Commissioner of Patents and Trademarks*